US007207158B2

(12) United States Patent
Tale' et al.

(10) Patent No.: US 7,207,158 B2
(45) Date of Patent: Apr. 24, 2007

(54) METHOD AND DEVICE FOR PRODUCING A TUBULAR WRAPPING

(75) Inventors: Fabrizio Tale', Bologna (IT); Mario Spatafora, Granarolo (IT)

(73) Assignee: G.D Societa' per Azioni, Bologna (IT)

( * ) Notice: Subject to any disclaimer, the term of this patent is extended or adjusted under 35 U.S.C. 154(b) by 73 days.

(21) Appl. No.: 10/984,948

(22) Filed: Nov. 9, 2004

(65) Prior Publication Data

US 2005/0279057 A1 Dec. 22, 2005

(30) Foreign Application Priority Data

Nov. 13, 2003 (IT) ..... BO2003A0673

(51) Int. Cl.
*B65B 7/00* (2006.01)
*B65B 9/00* (2006.01)

(52) U.S. Cl. ..... 53/476

(58) Field of Classification Search ..... 53/396, 53/397, 399, 450, 451, 444, 476, 148, 236, 53/550

See application file for complete search history.

(56) References Cited

U.S. PATENT DOCUMENTS 6,439,239 B1 * 8/2002 Spatafora et al. ..... 131/58
6,470,651 B1 * 10/2002 Polazzi et al. ..... 53/466
6,513,533 B2 * 2/2003 Spatafora et al. ..... 131/283
6,708,466 B2 * 3/2004 Spatafora ..... 53/466
6,964,148 B2 * 11/2005 Spatafora ..... 53/466

FOREIGN PATENT DOCUMENTS

| | | |
|---|---|---|
| EP | 0 854 084 | 7/1998 |
| EP | 1 052 171 | 11/2000 |
| EP | 1 145 957 | 10/2001 |
| EP | 1 262 409 | 12/2002 |

* cited by examiner

*Primary Examiner*—Rinaldi I. Rada
*Assistant Examiner*—John Paradiso
(74) *Attorney, Agent, or Firm*—Ladas and Parry LLP

(57) ABSTRACT

A folding method and device, whereby a tubular wrapping is formed about a product by inserting the product inside a U-shaped pocket together with a sheet of wrapping material, a first lateral portion of which is interposed between the product and a first lateral wall of the pocket, and a second lateral portion of which, opposite the first, is folded outside and beyond the pocket and crosswise to the first lateral portion; the tubular wrapping being closed by moving the first lateral wall of the pocket outwards, simultaneously moving a contrast member onto the first lateral portion, and then folding the second lateral portion, by means of an external folding member, onto the product and so as to overlap the first lateral portion; and the tubular wrapping being fixed inside the pocket by withdrawing the external folding member, simultaneously closing the first lateral wall onto the product, and withdrawing the contrast member (34) from the pocket.

12 Claims, 4 Drawing Sheets

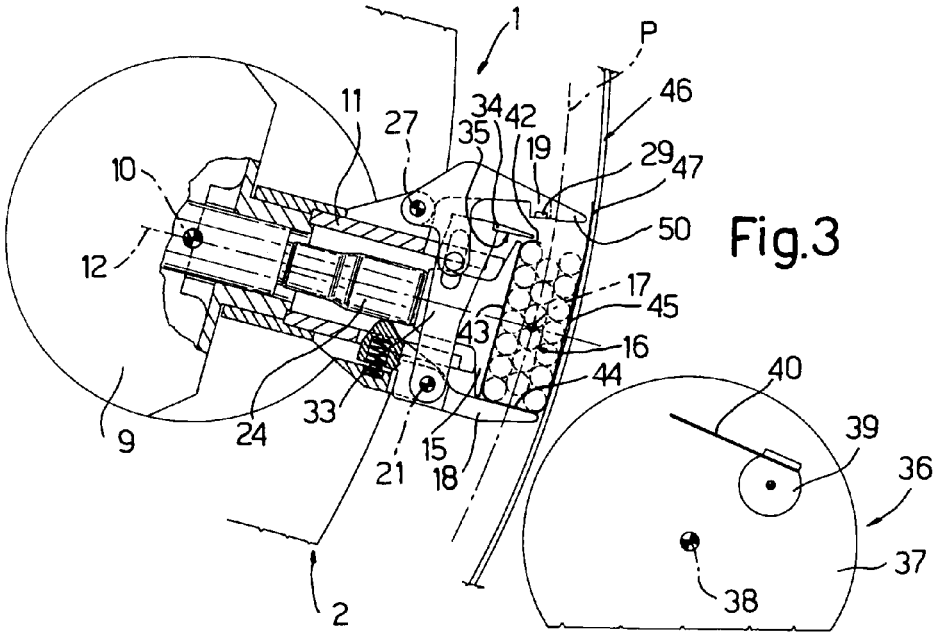
Fig.3
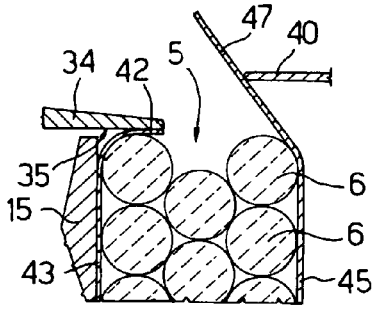
Fig.8
Fig.4
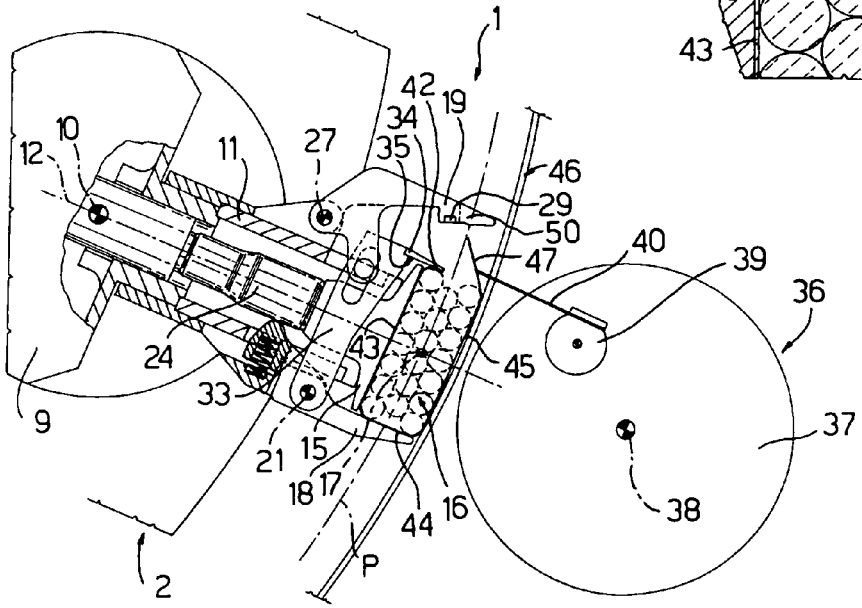

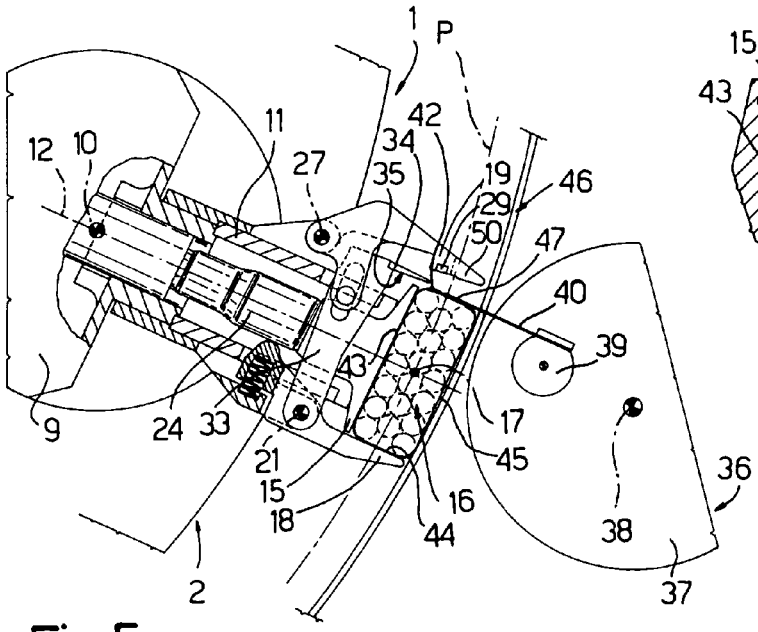
Fig.5
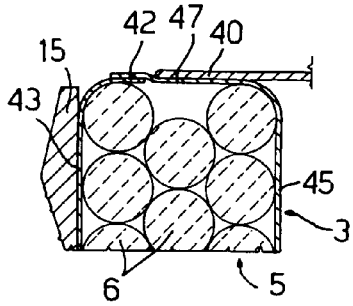
Fig.9
Fig.10
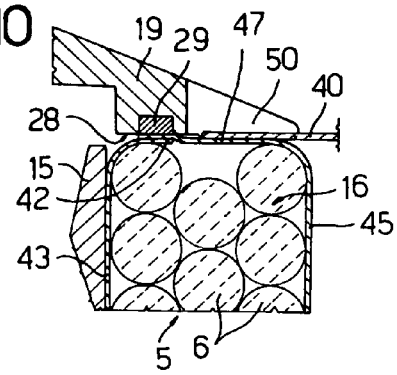
Fig.6
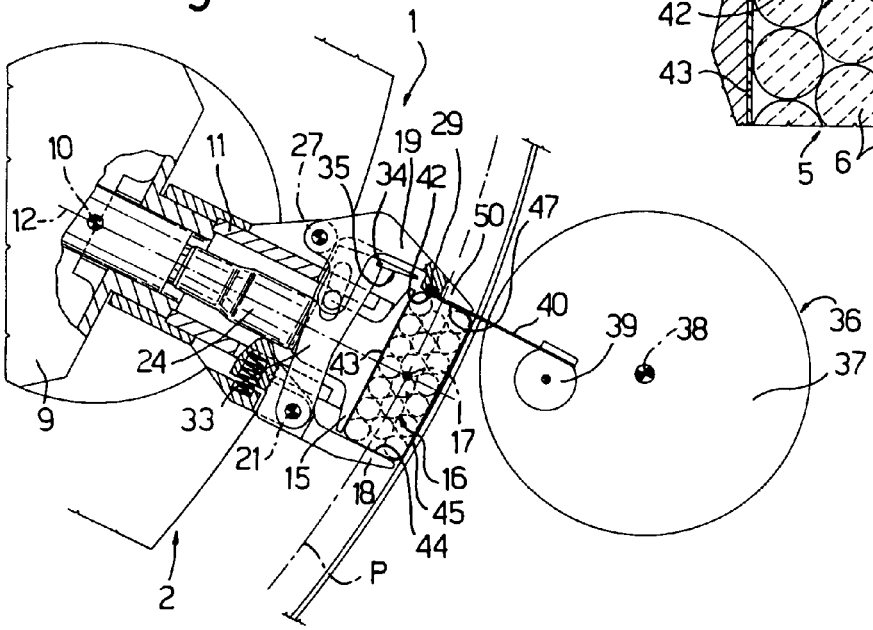

METHOD AND DEVICE FOR PRODUCING A TUBULAR WRAPPING

The present invention relates to a folding method and device for forming a tubular wrapping about a product, whereby the product, together with a sheet of wrapping material, is inserted inside a U-shaped pocket having a longitudinal axis and comprising a first and a second lateral wall parallel to said longitudinal axis, to fold the sheet of wrapping material so that a first lateral portion of the sheet of wrapping material is interposed between the product and the first lateral wall of the pocket, and a second lateral portion of the sheet of wrapping material, opposite the first, is folded outside and beyond the pocket and crosswise to the first lateral portion.

BACKGROUND OF THE INVENTION

Though suitable for wrapping any type of product, in particular substantially parallelepiped-shaped products, the present invention may be used to advantage in the tobacco industry for wrapping groups of cigarettes to form inner packets and/or for wrapping inner packets to form so-called "soft" packets, to which the following description refers purely by way of example.

SUMMARY OF THE INVENTION

It is an object of the present invention to provide a folding method as described above, for producing a tubular wrapping, which is easy to implement, is particularly suitable for use on continuous machines, i.e. in which said pocket is fed continuously along an endless path, and ensures closure of the tubular wrapping without subjecting the sheet of wrapping material to inevitably harmful shock against fixed folding members.

According to the present invention, there is provided a folding method for forming a tubular wrapping about a substantially parallelepiped-shaped product, the method comprising the steps of inserting the product, together with a sheet of wrapping material, inside a U-shaped pocket having a longitudinal axis and comprising a first and a second lateral wall parallel to said longitudinal axis, so as to fold said sheet of wrapping material so that a first lateral portion of the sheet of wrapping material is interposed between the product and said first lateral wall, and a second lateral portion of the sheet of wrapping material, opposite the first, is folded outside and beyond the pocket and crosswise to the first lateral portion; the method being characterized by comprising the further steps of moving said first lateral wall from a closed position contacting the product, to an open position opening said pocket, while at the same time holding said first lateral portion folded down on the product by moving a contrast member from a rest position outside said pocket, to a work position contacting the first lateral portion; subsequently folding said second lateral portion onto the product, and so as to overlap the first lateral portion, by inserting an external folding member into the pocket; returning said first lateral wall to the closed position, and said contrast member to said rest position; and withdrawing said external folding member from the pocket.

According to the present invention, there is also provided a device for laterally closing a tubular wrapping about a substantially parallelepiped-shaped product, the device comprising a U-shaped pocket having a longitudinal axis and in turn comprising a first and a second lateral wall parallel to said longitudinal axis, said pocket receiving a product with the interposition of a sheet of wrapping material comprising a first lateral portion interposed between the product and said first lateral wall, and a second lateral portion opposite the first and extending outside and beyond the pocket and crosswise to the first lateral portion; the device being characterized in that said first lateral wall is movable between a closed position and an open position respectively closing and opening said pocket; and by comprising an external folding member for engaging and inserting said second lateral portion inside said pocket and into a position overlapping said first lateral portion when said first lateral wall is in the open position; and a contrast member movable between a rest position outside said pocket, and a work position inside said pocket to hold said first portion folded down on said product when said first lateral wall is in the open position.

BRIEF DESCRIPTION OF THE DRAWINGS

A non-limiting embodiment of the present invention will be described by way of example with reference to the accompanying drawings, in which:

FIGS. 2 to 6 are similar to FIG. 1, and show the FIG. 1 folding device in further different operating positions;

FIG. 8 shows a larger-scale view of a detail in FIG. 4;

FIG. 9 shows a larger-scale view of a detail in FIG. 5;

FIG. 10 shows a larger-scale view of a detail in FIG. 6.

DETAILED DESCRIPTION OF THE INVENTION

Figure 1:
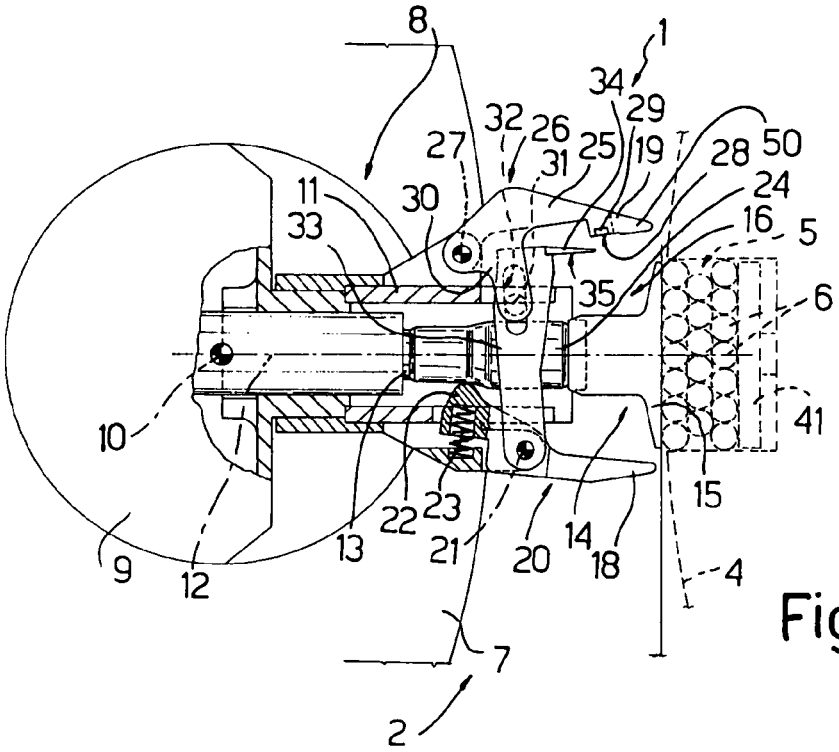
FIG. 1 shows a schematic partial section of a preferred embodiment of the folding device according to the present invention in one operating position.

Number 1 in FIGS. 1 to 6 indicates as a whole a folding device fitted to a wrapping machine 2 to form a tubular wrapping 3 (FIG. 9), defined by a sheet of wrapping material 4, about a substantially parallelepiped-shaped product—in the example shown, a group 5 of cigarettes 6.

Device 1 comprises a wrapping wheel 7 fitted to wrapping machine 2 to rotate continuously clockwise, in FIGS. 1 to 6, about an axis (not shown) perpendicular to the FIG. 1 plane. Wrapping wheel 7 supports a number of folding heads 8 (only one shown) equally spaced about the axis (not shown) of wrapping wheel 7, and each comprising a cylindrical base 9 fitted to wrapping wheel 7 to oscillate, under the control of a known control device not shown, about a respective axis 10 parallel to the axis (not shown) of wrapping wheel 7. Each folding head 8 also comprises a radial tubular arm 11, which has an axis 12, extends outwards of wrapping wheel 7 from relative base 9, and oscillates in known manner with relative base 9 about relative axis 10. Tubular arm 11 houses a rod 13, coaxial with axis 12, of a pusher 14, which also comprises a plate fitted to the free end of rod 13 and defining the end wall 15 of a U-shaped pocket 16, which is positioned with its concavity facing outwards of wrapping wheel 7, has a longitudinal axis 17 (FIG. 2) parallel to relative axis 10, and houses a respective group 5 with relative cigarettes 6 extending parallel to longitudinal axis 17.

End wall 15 is crosswise to respective axis 12, and relative pocket 16 also comprises a lateral wall 18 downstream in the travelling direction of pocket 16; and a lateral wall 19, which is upstream in the travelling direction of pocket 16, faces and is substantially parallel, at least in a closed work position, to lateral wall 18, and is crosswise to end wall 15.

Lateral wall 18 is defined by one arm of a rocker arm 20, which is hinged to the end of tubular arm 11 to oscillate, with respect to tubular arm 11, about an axis 21 parallel to relative axis 10, and comprises a further arm, which extends inside tubular arm 11, alongside rod 13, and defines a tappet 22, which is pushed by a spring 23 into contact with a cam 24 fitted to rod 13 and movable with rod 13 to set lateral wall 18 to a normal closed position (FIG. 2) when end wall 15 is withdrawn to the back of pocket 16, and to an open position when end wall 15 is in an extracted position (FIG. 1) outside lateral walls 18 and 19.

Lateral wall 19, which is similar in form to lateral wall 18, is defined by the free end of one arm 25 of a rocker arm 26 fitted to a powered shaft 27, which is parallel to relative axis 10 and oscillates about a respective axis to move relative lateral wall 19 between said closed work position (FIG. 6) and an open position (FIG. 3). Lateral wall 19 is also provided, on a front surface 28, with a heating device 29.

Rocker arm 26 comprises a further arm 30, which extends substantially perpendicularly to relative arm 25 towards relative axis 12, and is fitted on its free end with a pin 31 parallel to relative axis 10 and sliding transversely inside an axial slot 32 of a link 33 fitted to tubular arm 11 to oscillate about axis 21. Link 33 extends from axis 21 towards rocker arm 26, and is fitted on its free end with a contrast member defined by a plate 34, which is substantially perpendicular to link 33 and oscillates with link 33 between a withdrawn rest position (FIG. 6), in which plate 34 is positioned radially inwards of relative pocket 16, and a forward work position (FIG. 4), in which plate 34 is positioned partly inside relative pocket 16, with a front lateral surface 35 of plate 34 positioned coplanar with the position occupied by front surface 28 of relative lateral wall 19 when lateral wall 19 is in the closed work position.

Link 33 and rocker arm 26 are connected, by relative pin 31 engaging relative slot 32, so that, when relative lateral wall 19 moves to and from the closed work position, plate 34 moves to and from the withdrawn rest position.

With reference in particular to FIGS. 3 to 6, wrapping wheel 7 feeds pockets 16 continuously along an endless, in particular, circular path P extending through a folding station 36, through which pockets 16 travel successively, and which comprises a disk 37 fitted to wrapping machine 2 to rotate continuously anticlockwise, in FIGS. 3 to 6, about an axis 38 parallel to axis 10. Folding station 36 also comprises a shaft 39 fitted through disk 37, parallel to and eccentric with respect to axis 38, to oscillate about a respective axis under the control of a known cam device (not shown); and a folding member 40 defined by a blade fitted to shaft 39 and extending outwards of disk 37 from shaft 39.

Operation of device 1 will be described below with reference to one pocket 16 and one group 5, which, on reaching, in known manner, a position facing pocket 16 together with a respective sheet of wrapping material 4, is fed, in known manner, along path P at the same speed as pocket 16, and is gripped between a pusher 41 (FIG. 1) external to pocket 16, and end wall 15 moved by pusher 14 into an extracted position (FIG. 1) radially outwards of lateral walls 18 and 19, which are both in the open position, lateral wall 18 by tappet 22 contacting cam 24 fitted to rod 13, and lateral wall 19 by operation of shaft 27.

Subsequent movement of end wall 15 and external pusher 41 inwards of wrapping wheel 7, together with a simultaneous movement of lateral wall 18 and a subsequent movement of lateral wall 19 into their closed positions (FIG. 2), forms pocket 16 and causes insertion inside pocket 16 of group 5 and relative sheet of wrapping material 4, which, as it is being inserted inside pocket 16, is folded about group 5 to define a narrow portion 42 contacting front surface 28 of lateral wall 19 and of a transverse dimension smaller than half the width of lateral wall 19; an inner portion 43 extending along end wall 15; and a lateral portion 44 extending along lateral wall 18. A portion, integral with lateral portion 44, of the sheet of wrapping material 4 projects from pocket 16, and comprises an outer portion 45, which, as pocket 16 travels along path P, is folded (FIG. 2) in known manner, e.g. by encountering an outer plate 46, onto group 5 into a position parallel to and facing inner portion 43; and a portion 47 projecting rearwards, in the form of an extension of portion 45, outwards of and beyond pocket 16 in a direction crosswise to portion 42. Portion 47 is of a transverse dimension greater than the transverse dimension of portion 42, and greater than the width of front surface 28 of lateral wall 19 minus the width of portion 42.

Figure 2:
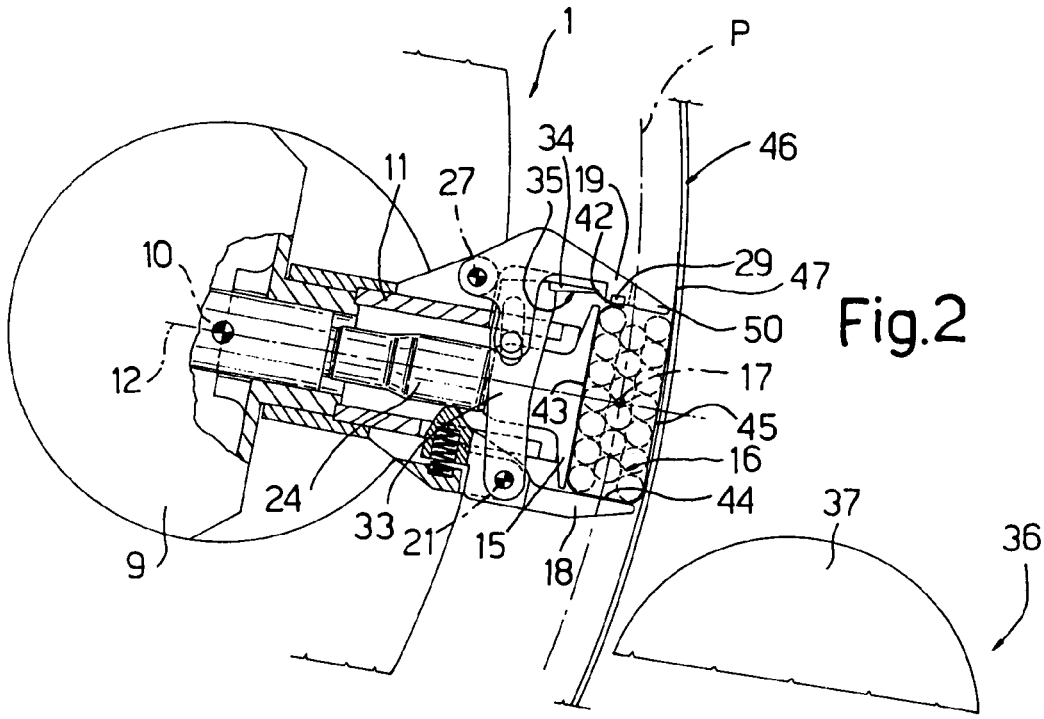

Pocket 16, together with relative group 5 and relative sheet of wrapping material 4, is then fed by wrapping wheel 7 through folding station 36, prior to reaching which, lateral wall 19 is moved, by oscillation of powered shaft 27 and in the opposite direction to the travelling direction of pocket 16, from the closed work position shown in FIG. 2, to the open position shown in FIGS. 3 to 5.

At the same time, the coupling between pin 31 and slot 32 causes relative plate 34 to move from the withdrawn rest position to the forward work position, in which plate 34 is positioned parallel to axis 12, with its lateral surface 35 contacting portion 42 (FIGS. 4 and 8) to hold portion 42 folded down on group 5 throughout the time lateral wall 19 remains in the open position.

Pocket 16, still with lateral wall 19 in the open position, eventually reaches folding station 36 (FIG. 4) where, by continuous rotation of disk 37 about axis 38 and oscillation of shaft 39, folding member 40 accompanies pocket 16 rotating about the axis (not shown) of wrapping wheel 7, and, at the same time, is inserted radially through plate 46 into pocket 16, between group 5 and lateral wall 19 in the open position, to fold portion 47 (FIG. 4) inside pocket 16, onto group 5, and into a position at least overlapping portion 42 (FIGS. 5 and 9).

Figure 7:
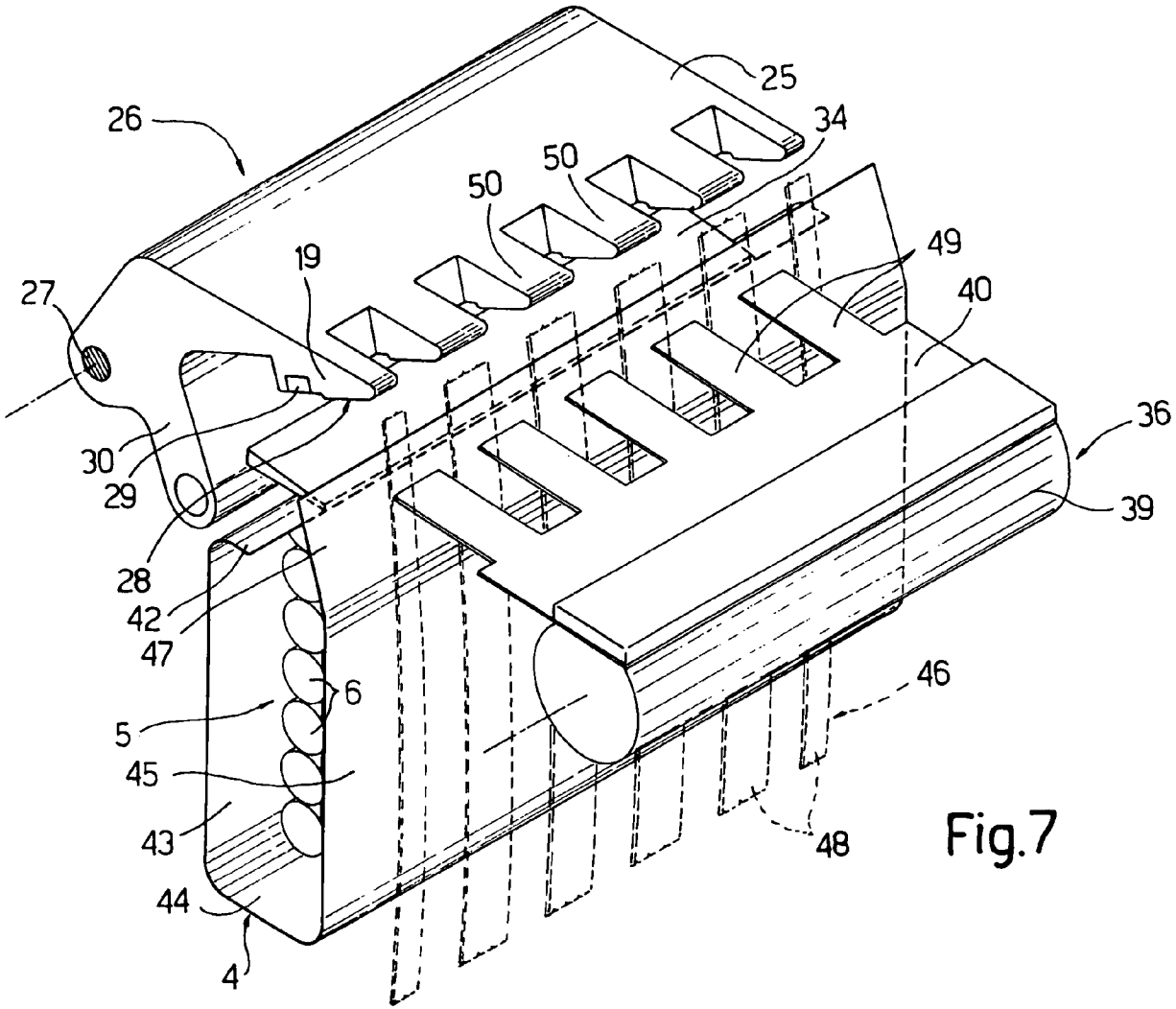
FIG. 7 shows a larger-scale view in perspective of a detail in FIGS. 1 to 6.

As shown in FIG. 7, to enable passage of folding member 40 through plate 46, plate 46 is defined, at least at folding station 36, by a number of parallel strips 48, and the blade defining folding member 40 is comb-shaped, and comprises a succession of teeth 49, each of which engages a relative gap defined between two adjacent strips 48.

After smoothing portion 47 onto group 5 (FIGS. 5 and 9), folding member 40 withdraws from pocket 16, while still remaining substantially parallel to lateral wall 18 (FIGS. 6 and 10). Just before folding member 40 withdraws, lateral wall 19 is returned to the closed work position, thus moving plate 34 into the withdrawn rest position. As shown in FIG. 7, for it to close fully despite the presence of folding member 40, lateral wall 19 comprises an end portion defined by a row of teeth 50, which, when lateral wall 19 is in the closed work position, engage teeth 49 of folding member 40 comb-fashion.

As front surface 28 of lateral wall 19 contacts lateral portion 47, the heating device 29 on lateral wall 19 glues portion 47 to portion 42, at the overlap between portions 42 and 47, by melting hot-melt glue (not shown) deposited beforehand on at least one of portions 42 and 47. Alternatively, if the sheet of wrapping material 4 is made of heat-seal material, heating device 29 simply seals portions 42 and 47 to each other.

The invention claimed is:

1. A folding method for forming a tubular wrapping about a substantially parallelepiped-shaped product, the method comprising the steps of:

inserting the product (5), together with a sheet of wrapping material (4), inside a U-shaped pocket (16) having a longitudinal axis (17) and comprising a first and a second lateral wall (19, 18) parallel to said longitudinal axis (17), so as to fold said sheet of wrapping material (4) so that a first lateral portion (42) of the sheet of wrapping material is interposed between the product (5) and said first lateral wall (19), and a second lateral portion (47) of the sheet of wrapping material, opposite the first, is folded outside and beyond the pocket (16) and crosswise to the first lateral portion (42);

moving said first lateral wall (19) from a closed position contacting the product (5), to an open position opening said pocket (16), while at the same time holding said first lateral portion (42) folded down on the product (5) by moving a contrast member (34) from a rest position outside said pocket (16), to a work position contacting the first lateral portion (42);

subsequently folding said second lateral portion (47) onto the product (5), and so as to overlap the first lateral portion (42), by inserting an external folding member (40) into the pocket (16);

returning said first lateral wall (19) to the closed position, and said contrast member (34) to said rest position; and withdrawing said external folding member (40) from the pocket (16).

2. A method as claimed in claim 1, wherein said first lateral wall (19) is moved between said open position and said closed position by oscillating the first lateral wall (19) about a first axis (27) parallel to said longitudinal axis (17).

3. A method as claimed in claim 1, wherein said contrast member (34) is moved between said rest position and said work position by oscillating the contrast member (34) about a second axis (21) parallel to said longitudinal axis (17).

4. A method as claimed in claim 3, wherein said second lateral wall (18) is moved between said open position and said closed position by oscillating the second lateral wall (18) about said second axis (21).

5. A method as claimed in claim 1, wherein said contrast member (34) is moved from said rest position to said work position by said first lateral wall (19) moving from said closed position to said open position, and is moved from said work position to said rest position by said first lateral wall (19) moving from said open position to said closed position.

6. A method as claimed in claim 1, wherein said second lateral wall (18) is moved between an open position and a closed position, respectively opening and closing said pocket (16), during said step of inserting the product (5) and the relative sheet of wrapping material (4) inside the pocket (16).

7. A method as claimed in claim 1, and comprising a step of connecting said first and said second lateral portion (42, 47) to each other.

8. A method as claimed in claim 7, wherein said connecting step is a heat-seal step.

9. A method as claimed in claim 7, wherein said connecting step is a gluing step performed by melting hot-melt glue deposited on at least one of said first and second lateral portions (42, 47).

10. A method as claimed in claim 7, wherein said connecting step is performed by heating means (29) carried by said first lateral wall (19).

11. A method as claimed in claim 1, wherein said pocket (16) forms part of a wrapping wheel (7) rotating continuously to feed the pocket (16) along an endless path (P) extending through a folding station (36); said external folding member (40) being inserted inside the pocket (16) as said pocket (16) travels through said folding station (36).

12. A method as claimed in claim 11, wherein said path (P) is a circular path.

* * * * *